United States Patent [19]

Kennard, Jr. et al.

[11] 4,068,762

[45] Jan. 17, 1978

[54] PICKUP TRUCK DERRICK

[76] Inventors: Dwight Clinton Kennard, Jr.; James Clinton Kennard, both of 3830 Incochee Trail, Mich. 49684

[21] Appl. No.: 612,296

[22] Filed: Sept. 11, 1975

[51] Int. Cl.[2] ..... B66C 23/06

[52] U.S. Cl. ..... 212/49; 212/46 R; 212/59 R; 212/145; 214/75 H

[58] Field of Search ..... 212/8 R, 9, 30, 31, 212/28, 35 R, 49, 58 R, 59, 144, 46, 145; 214/75 H

[56] References Cited

U.S. PATENT DOCUMENTS

| | | | |
|---|---|---|---|
| 708,625 | 9/1902 | Danielsen | 212/49 |
| 848,304 | 3/1907 | Hines | 212/8 R |
| 1,909,528 | 5/1933 | Garson | 212/59 R |
| 2,364,851 | 12/1944 | Johansen | 212/8 R |
| 2,557,192 | 6/1951 | Leister | 212/8 R |
| 2,777,112 | 1/1957 | Coker et al. | 212/8 R X |
| 2,777,586 | 1/1957 | Boysen et al. | 212/145 |
| 2,924,428 | 2/1960 | Whittall et al. | 212/35 |
| 3,080,068 | 3/1963 | Felkner | 212/144 |
| 3,173,549 | 3/1965 | Bender | 212/8 R |
| 3,433,368 | 3/1969 | Durand | 212/49 X |
| 3,797,672 | 3/1974 | Vermette | 212/8 R |

FOREIGN PATENT DOCUMENTS

| | | | |
|---|---|---|---|
| 470,956 | 1/1951 | Canada | 212/8 R |
| 889,882 | 1/1944 | France | 212/8 R |
| 714,499 | 11/1941 | Germany | 212/28 |
| 1,406,315 | 10/1968 | Germany | 212/46 R |

*Primary Examiner*—Lawrence J. Oresky
*Attorney, Agent, or Firm*—Price, Heneveld, Huizenga & Cooper

[57] ABSTRACT

A collapsible boom and derrick hoist assembly, including a base frame securable to the side rails of a conventional pickup truck. A collapsible A-frame supports a foldable, two-piece boom assembly. A boom swing mechanism includes a gear driven arrangement for rotating the boom or yawing the boom about its vertical axis. A boom elevating mechanism including a winch, cable, and a pivotally supported pulley permits elevation of the erected two-piece boom with the elevation angle remaining constant as the boom swings about its vertical axis. An A-frame erection subassembly including a strut arrangement for obtaining a mechanical advantage is provided along with a boom erection and winching cable arrangement. A plurality of screw jacks are pivotally connected to side members of the base frame and serve to support the derrick hoist assembly and stabilize the assembly during operation.

25 Claims, 20 Drawing Figures

PICKUP TRUCK DERRICK

BACKGROUND OF THE INVENTION

This invention relates to material handling apparatus, and more particularly, it concerns a portable hoist of the type which may be securable to the side rails of a conventional pickup truck.

In various operations a need exists for material handling apparatus capable of lifting up to approximately one-half ton. For example, home builders require hoisting apparatus to load and unload lumber and other materials, to hoist roof trusses in place, to hoist roofing materials, to hoist bricks and mortar, to set I-beams, and for many other operations. A general home building contractor does not wish to invest a large sum of money either in the rental or purchase of a self-propelled derrick or crane vehicle. Further, such crane vehicles generally have a load carrying capacity which greatly exceeds the loads which would be encountered in general home building. Further, in activities such as sign installation, general warehouse moving, farming, and boat launching and storage, high load carrying capacities are not required. Operators not having the need for large, self-propelled equipment would prefer to purchase or rent a hoist readily adaptable to a conventional pickup truck, while at the same time retaining the use of the truck for other purposes.

Heretofore, several truck mounted arrangements have been available having a limited hoisting or lifting capacity. For example, U.S. Pat. No. 3,797,672 to Vermette, entitled APPARATUS ATTACHABLE TO A TRUCK BODY OR THE LIKE FOR USE FOR HOISTING OR LIFTING, OR AS AN ELEVATED SUPPORT, issued Mar. 19, 1974, discloses a device having a frame attachable to stake holes of a pickup truck and supporting a single, vertically extending boom. Attached to the top of the boom is a cross member to which a cable hoist is secured. The boom is collapsible in a forward direction to permit transportation of the apparatus. This arrangement, however, while resulting in unobstructed use of the bed of the pickup truck, is limited in the area that can be reached by the hoist hook. Further, no provision is made for increasing the stability of the assembly during hoisting operation.

U.S. Pat. No. 2,541,970 to Pospisil entitled "THREE-LEG TRUCK MOUNTED DERRICK," issued Feb. 13, 1951, discloses a portable derrick arrangement which permits hoisting only from the rear of a truck body. This apparatus does not permit hoisting from points around the sides as well as the back of the vehicle.

Therefore, a need exists for a collapsible boom and derrick hoist assembly mountable on a pickup truck or other such vehicle and possessing complete roadability, the ability to elevate a load, and having a hook swing or reach permitting operation around the sides of the transportation vehicle.

SUMMARY OF THE INVENTION

In accordance with the present invention, an improved, portable hoist assembly is provided which is mountable to a pickup truck and capable of hoisting and swinging a load. Essentially, the collapsible boom and derrick hoist assembly includes a rectangular mounting or base frame securable to the side rails of a conventional pickup truck. A collapsible A-frame carrying a support plate at the apex end is pivotally secured to the mounting frame. Provision is made for supporting the A-frame and for erecting the A-frame to a vertical position. A foldable, two-piece boom assembly is pivotally and swingably carried at the A-frame support plate. Provision is made for erecting the boom from a folded, stored position, for elevating the boom during hoisting operations, and for swinging the boom about a vertical axis.

The A-frame is collapsible to a lowered, transporting position and the two-piece boom assembly is foldable to a "V" configuration along the legs of the collapsible A-frame. A hoisting system results in hoist cable operation which is independent of boom yawing or pitching motions. A boom elevating system is provided whereby the elevation angle is unchanged by boom yawing motion.

A plurality of stabilizer jack assemblies are pivotally connected to the side rails of the main mounting frame. These jacks lift the assembly to or from the side rails of the pickup truck, and stabilize the assembly during hoisting operations.

Among the objects of the present invention, therefore, are: the provision of a derrick assembly which can be mounted on a standard pickup truck; the provision of a derrick assembly including a pivotally and rotatably mounted boom; the provision of a collapsible boom and derrick hoist assembly which folds for compact storage during transportation; the provision of a hoisting cable system for a collapsible boom and derrick hoist assembly which permits boom pitching and yawing motions independent of the hoisting action; the provision of a collapsible, portable boom and derrick hoist assembly including a boom swing mechanism having a gear driven arrangement for rotating the boom about its vertical or yaw axis; the provision of a boom and derrick hoist assembly including folding stabilizer jack units resulting in simple installation, removal and operation on a standard pickup truck; and the provision of an improved, collapsible boom and derrick hoist assembly by which the problems heretofore experienced are substantially alleviated.

DETAILED DESCRIPTION OF THE PREFERRED EMBODIMENT

Figure 1:
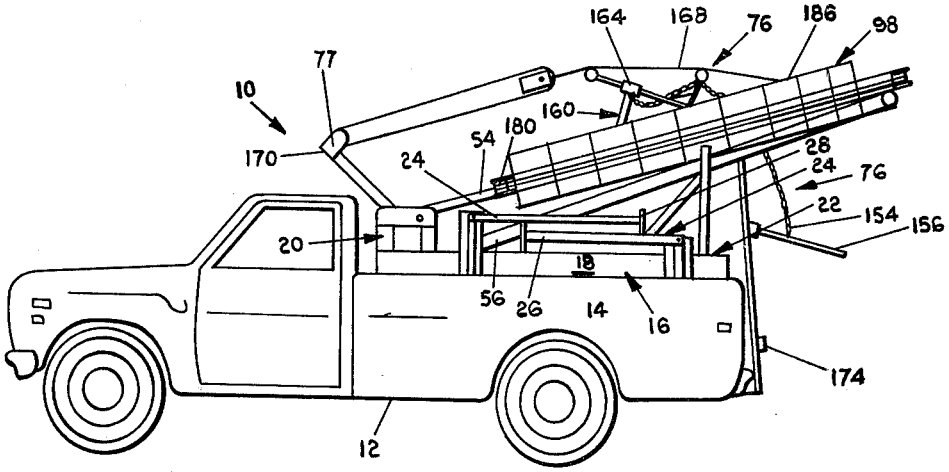
FIG. 1 is a side elevational view of a boom and derrick hoist assembly in accordance with the present invention mounted on a conventional pickup truck in a collapsed, transportation position.
Figure 2:
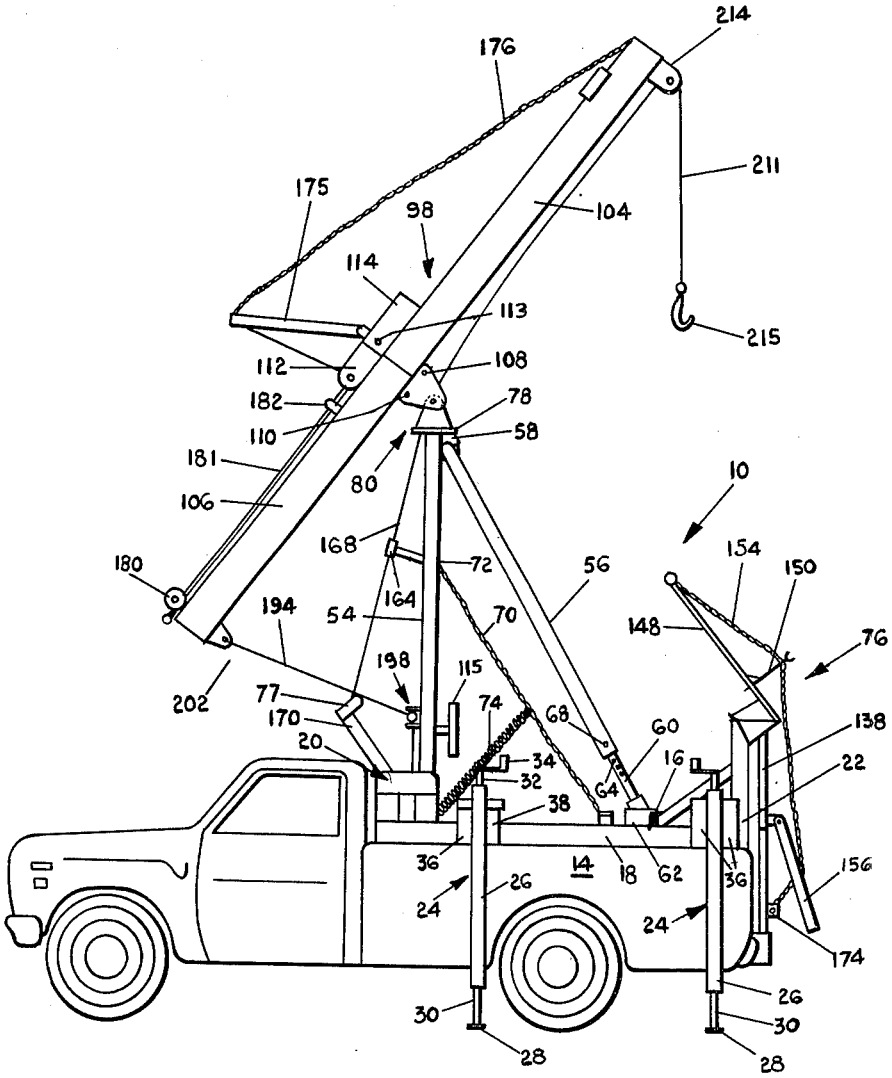
FIG. 2 is a side elevational view of the erected boom and derrick hoist assembly of FIG. 1.
Figure 3:
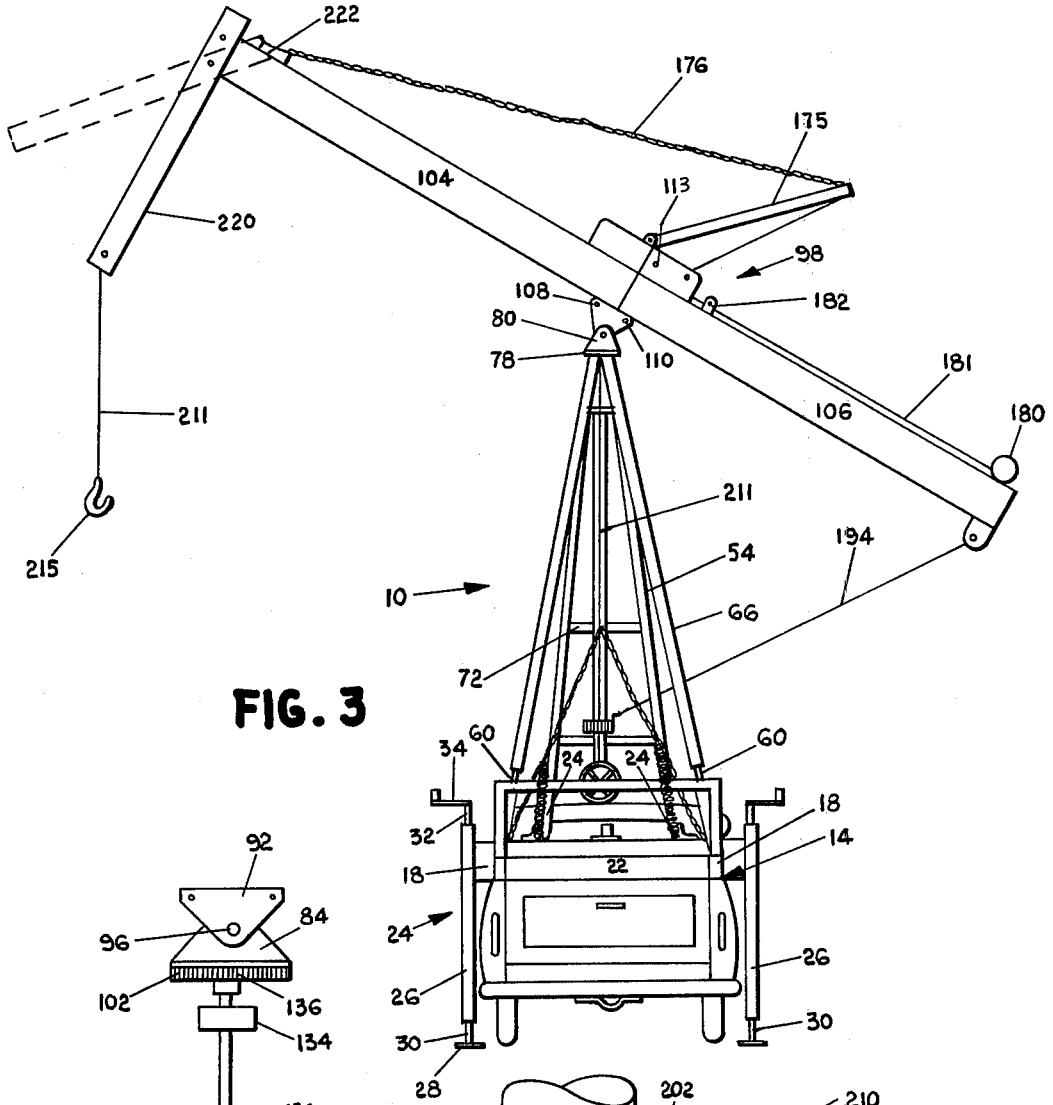
FIG. 3 is a rear elevational view of the assembly of FIGS. 1 and 2.

FIGS. 1, 2 and 3 illustrate a foldable boom and collapsible derrick hoist assembly in accordance with the present invention and, generally designated 10. The assembly 10 is mounted to a conventional pickup truck 12 at side rails 14. A base or mounting frame 16 of the assembly includes two, longitudinal structural members or side members 18 and forward and rear cross members 20 and 22, respectively.

The side members 18, which may be formed from wood or metal, are positioned flat on the top edges of each truck side rail 14. The side members are anchored in place by vertical stakes (not shown) which project into the standard stake sockets in the side rails 14 of the conventional pickup truck 12.

A plurality of stabilizer jack assemblies 24 are pivotally secured to the side members 18 at forward and rear positions on each side of the main frame 16. As shown in FIG. 1, stabilizer jack assemblies 24 are foldable towards one another and upwardly to a transporting position resting on the side members 18 of the base 16. Each stabilizer jack assembly 24 includes an outer housing 26 and support pads 28 secured to telescoping legs 30. A conventional screw 32, which may be turned by hand lever 34, is employed to extend each leg 30 and support pad 28. Bubble-type levelers (not shown) may be mounted along both the longitudinal and transverse axes of a side member 18 to assist in leveling the assembly.

Figure 12:
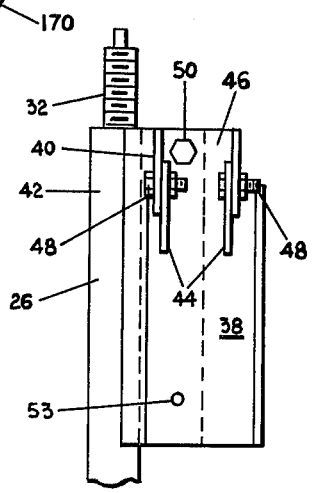
FIGS. 12 and 13 are enlarged, front and side elevational views, respectively, of the folding stabilizer jack assemblies.
Figure 13:
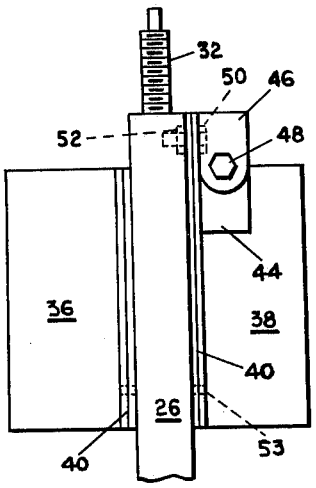

As best seen in FIGS. 12 and 13, each jack assembly 24 is mounted to the base members 18 by an arrangement including two right angled fixtures 36 and 38. The right angled fixtures are secured to the side members 18 and longitudinally spaced so as to receive the outer housing 26 of the jack 24. Plates 40 are weldably or otherwise suitably secured to faces 42 of the housing 26. Right angle fixture 38 has weldably secured to one face thereof a pair of pivot ears 44. Pivotally secured to the ears 44 is a pivot bracket or hinge leaf 46. The pivot bracket 46 is secured to the ears 44 by a pair of bolts and nuts 48. The jack plate 40 is secured to the pivot bracket 46 at its upper corner by a single bolt 50 and nut 52. A pin may be inserted through an aperture 53 to secure the housing 26 to the brackets 36 and 38.

As a result of this mounting arrangement, the housing 26 of the stabilizer jack may be pivoted outwardly away from the side of the pickup truck until the plates 40 clear the right angle fixtures 38 and 36. The jacks 24 may then be pivoted upwardly and inwardly towards the center of the truck to the position shown in FIG. 1.

COLLAPSIBLE A-FRAME ASSEMBLY

The foldable boom and derrick hoist assembly includes an A-frame 54 pivotally supported at the forward cross member 20 of base or main support frame 16. As shown in FIGS. 1 and 2, the A-frame is pivotal from a travel position where it rests on the upper surface of the rear cross member 22 to a vertical, operating position. A pair of support legs 56 are pivotally connected at one end 58 to the upper, converging end of the A-frame 54. The support legs 56 include telescoping, inner leg members 60 (FIG. 2) which are adapted to fit within support sockets 62. The support sockets 62 are fixably secured to the upper surface of the side members 18. Each telescoping leg 60 is formed with a plurality of apertures 64. A pin extends through an aperture 68 formed in the lower portion of the main support legs 56 to secure the telescoping legs 60.

As best seen in FIGS. 2 and 3, a pair of chains 70 or the like extend from a cross member 72 of the A-frame 54 to points on each side of the side members 18. These chains 70 function as safety members to limit the forward, pivotal movement of the A-frame relative to the base 16. A pair of coil-type springs or other resilient means 74 are secured at the forward cross member 20 of the base frame or to side members 18 at one end and to the central portion of the chains 70. These springs exert an over-center pull on the A-frame 54 and assist in returning the A-frame to its folded, travel position.

An auxiliary erecting strut assembly 76, as more fully described below, is employed along with a differential winch 77 for erecting and collapsing the A-frame 54 and support leg assembly 56.

BOOM ASSEMBLY

Figure 11:
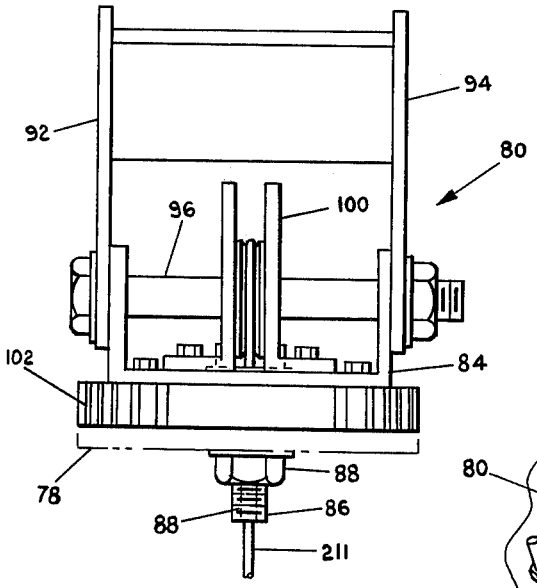
FIG. 11 is a fragmentary detail of the boom pivot assembly in accordance with the present invention.

At the truncated apex or converging end of A-frame 54 is mounted a boom mounting plate or bearing plate 78. Secured to the bearing plate 78 is a boom pivot or trunnion assembly 80. As best seen in FIGS. 2 and 11, the boom pivot assembly 80 includes a lower, generally U-shaped, yoke 84. The yoke 84 is mounted to the bearing plate 78 by a special bolt 86 and nut 88. The bolt 86 includes a central passage 88 for reasons which will become readily apparent.

An upper yoke 90 having depending side plates 92 and 94 is hingedly secured to the upwardly extending side plates of the lower yoke 84 by a shaft 96. Pivotally secured to the upper yoke 90 is the foldable boom assembly 98. As best seen in FIG. 11, a pulley 100 is rotatably supported on the shaft 96. This pulley forms a part of the hoist cable system as will be more fully described below. Secured to the lower yoke 84 and bearing on the plate 78 is a straight cut spur gear 102 (FIGS. 4 and 14) which forms the output drive section of the boom swinging or yawing mechanism.

Boom assembly 98 includes two sections, a forward hoist section 104 and a rearward counterbalance section 106. Both members 104 and 106 are readily formed from conventional steel I-beams. The rear end of hoist member 104 is pivotally secured at 108 to upper yoke 90, and the forward portion of counterbalance member 106 is pivotally secured at 110 to upper yoke 90. As shown in FIG. 2, each member 104 and 106 includes mating plates 112 and 114 having a pair of matching holes through which a pin 113 is inserted to secure the boom members together. Alternatively, a latching mechanism may be substituted for the pin connection.

BOOM SWINGING MECHANISM

Figure 4:
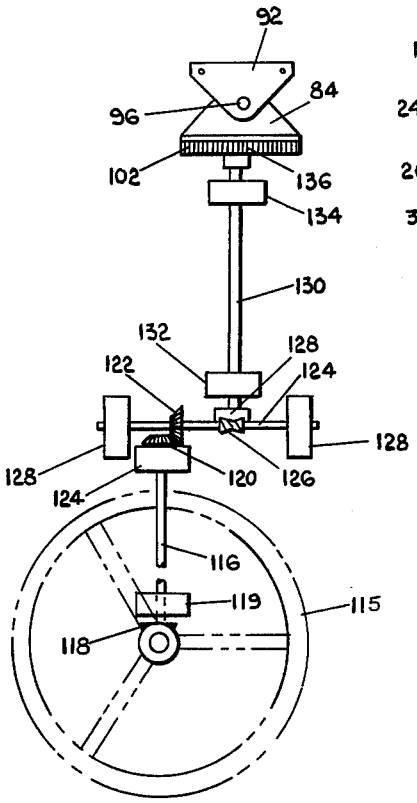
FIG. 4 is a schematic illustration of the boom swinging mechanism employed with the present invention.
Figure 14:
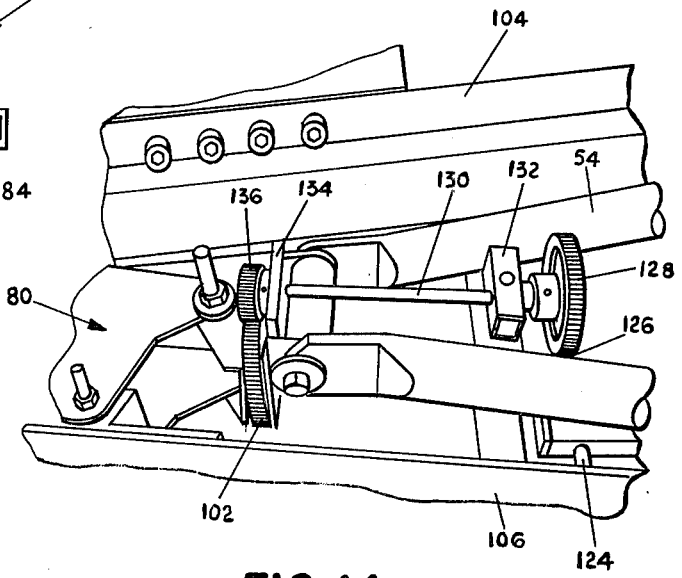
FIG. 14 is a fragmentary, enlarged detail view of the boom yawing mechanism schematically illustrated in FIG. 4.

The boom assembly 98 may be swung or rotated about a vertical yawing axis by a gear system schematically illustrated in FIGS. 4 and 14. As shown, the gear system may include a conventional steering-type wheel 115 rotatably mounted to a cross member 192 (FIG. 8) on the A-frame 54 by a bearing assembly 193. As shown in FIG. 4, the wheel rotates a drive shaft 116 having bevel gears 118 and 120 secured at opposite ends thereof. Drive shaft 116 is supported by bearing blocks 119 and 121. The uppermost bevel gear 120 rotates a bevel gear 122 nonrotatably secured to a stub shaft or cross shaft 124. The cross shaft 124 is supported by bearings 128 near the apex of the A-frame 54. Nonrotatably secured to the cross shaft 124 is a worm 126. As seen in FIG. 14, the worm 126 meshes with a worm gear 128 which is nonrotatably secured to a final drive shaft 130. The final drive shaft 130 is supported by bearing blocks 132 and 134 on the A-frame 54. A pinion gear 136 is nonrotatably secured to the opposite end of the final drive shaft 130. The pinion gear 136 meshes with the driven or final output gear 102. As a result, rotation of the wheel 114 results in rotation of the lower yoke 84 and hence swinging or yawing motion of the boom assembly 98. The center of the swing arc of the boom is parallel to the vertical axis of the A-frame and lies to the rear of the A-frame vertical plane. It is readily apparent that an electric drive motor or other power source may be substituted for the manually operated wheel 115.

A-FRAME ERECTION SYSTEM

Figure 9:
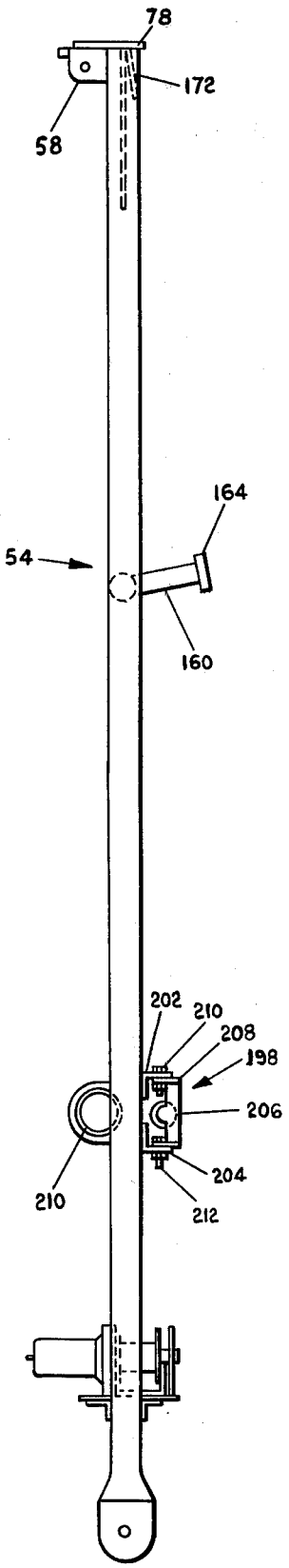
FIG. 9 is a side elevational view of the A-frame of FIG. 8.
Figure 10:
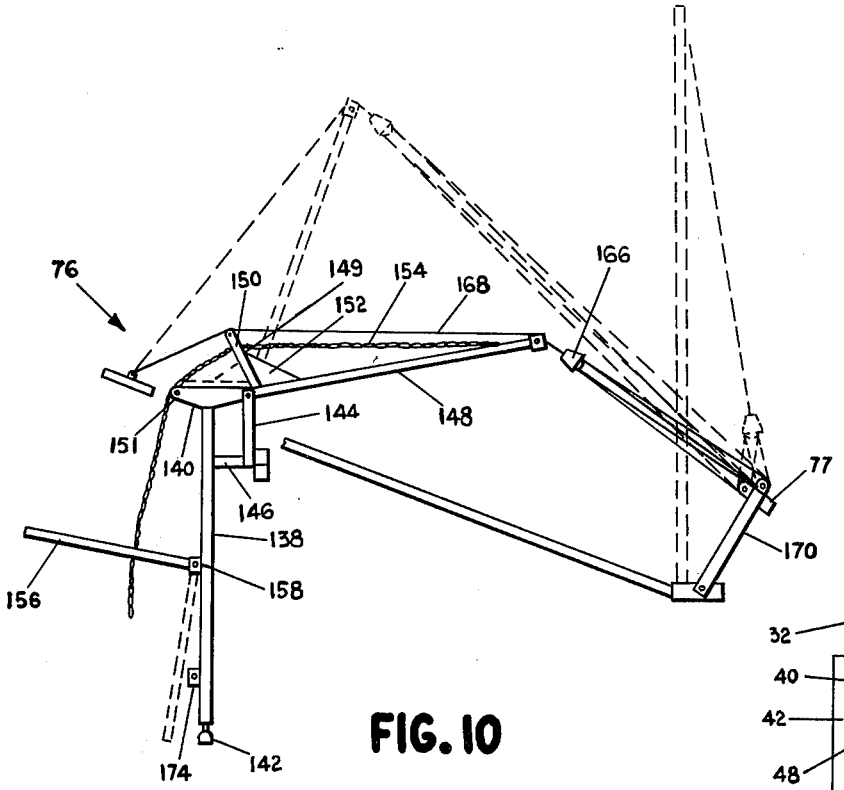
FIG. 10 is a schematic, partial, fragmentary detail view of the A-frame erection strut assembly of the present invention.

With reference to FIGS. 2, 9 and 10, the auxiliary erecting strut 76 is provided in order to increase the mechanical advantage of winch 77 during erection and collapsing of the A-frame. As shown, strut 76 includes a vertical post 138 rigidly secured at its upper end to a wing-shaped plate 140. At its opposite end, the post 138 is provided with a socket 142. The socket is adapted to rest on the ball of a hitch assembly (not shown). The wing plate 140 is rigidly secured to the rear cross brace member 22 by struts 144 and 146. An erecting strut 148 is pivotally secured to the wing plate 140 adjacent the point of attachment of the brace or strut 144. Welded or otherwise suitably secured to the erecting strut 148 is a right angle strut 150 suitably gusseted at 152. A chain or flexible connective member 154 extends rearwardly from the forward end of the strut 148 over a roller 149 supported intermediate the ends of strut 150 and over a roller 151 disposed on the rearward end of the wing plate 140. The chain extends downwardly and is secured to a lever 156. The lever is pivotally secured to the post 138 at a pivot bracket 158.

Figure 8:
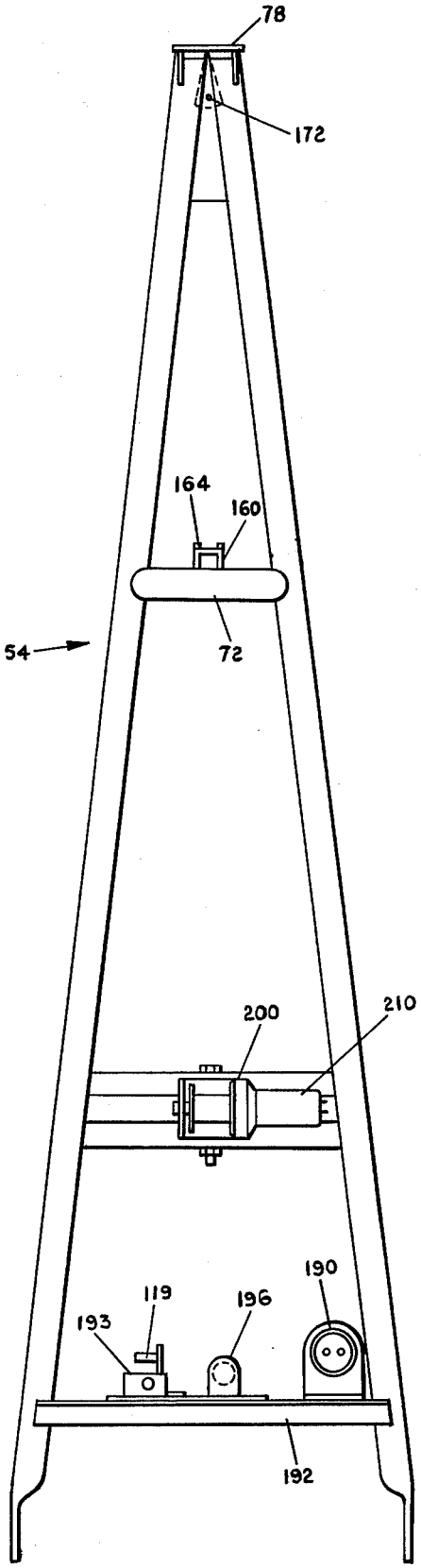
FIG. 8 is an enlarged, front elevational view of the A-frame of the present invention.

As best seen in FIG. 1, during transportation of the assembly, the strut 148 rests on a support strut 160 weldably secured to upper cross member 72 of the A-frame 54 (FIGS. 8 and 9). The support strut 160 includes a longitudinally extending trough-like, semicylindrical support pad 164 upon which the erection strut 148 rests. A winch arrangement 77 including block and tackle 166 and cable 168 is connected between a forward support beam 170 and a cable attachment plate 172 (FIG. 8) weldably secured at the apex of the A-frame 54.

In operation, sufficient cable is reeled out from winch arrangement 77 and lever 156 is pressed downwardly by an operator thereby raising or pivoting the erection strut 148 in an upward direction. The chain 154 is secured with a pin to a bracket 174 disposed near the lower portion of the post 138 as best seen in FIGS. 2 and 10. Erection winch 77 is then actuated and A-frame 54 is raised to its upward vertical position. The support legs 56 are then secured to the sockets 62. When folding the A-frame, the support legs 56 are disengaged from the sockets 62 and are folded forward. The telescoping legs 60 of support legs 56 are held in position for folding by screwing on end caps (not shown) fastened to the ends of short chains which allow the legs to float free during the folding operation. The cable from the erecting winch is then reeled out and the whole A-frame assembly is lowered until it rests on the rear cross beam 22 located above the tailgate of the pickup truck.

BOOM ERECTION SYSTEM

Once the A-frame 54 has been placed in its vertical, upright position, the two-piece boom may then be erected. A main erection strut 175 is pivotally disposed between plates 114 on the hoist member 104 of the boom assembly 96. A chain 176 or other flexible connective member extends from the top of the erection strut 175 to a point near the end of the hoist member 104. In transit, the erection strut is folded and latched to the hoist member and the boom sections 104 and 106 are secured to the legs of the A-frame 54. A winch 180, which may be of the hand-operated or electric motor driven type, is disposed on the lower end of counterbalance portion 106 of the boom assembly. A cable 181 extends from the winch under a cable guide roller 182 to the end of the main erection strut.

In erecting the collapsible boom assembly, the hoisting portion of the boom 104 and a main strut are released from their traveling positions. The winch 180 is then actuated and strut 175 is raised to the position shown in FIGS. 2 and 7.

Figure 7:
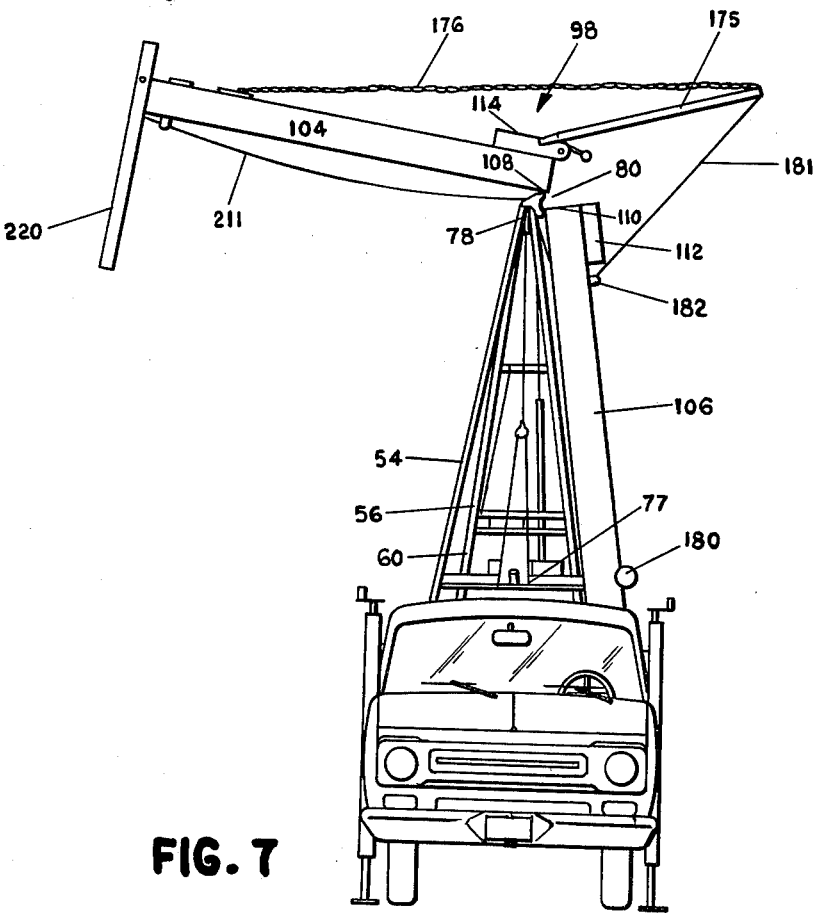
FIG. 7 is a front elevational view showing the boom structure partially erected.

As the cable is reeled in on the winch 180, the hoisting boom portion 104 is rotated upwardly, as shown in FIG. 7, until it mates with the counter boom portion 106. During the final stage of the erection process, the pivot assembly will shift so that the counterbalance portion of the boom moves downwardly. An operator then climbs the ladder 186 fixedly secured to the counterbalance portion of the boom (FIG. 1) and inserts locking pin 113 through the mating apertures of the boom sections.

BOOM ELEVATING SYSTEM

Figure 5:
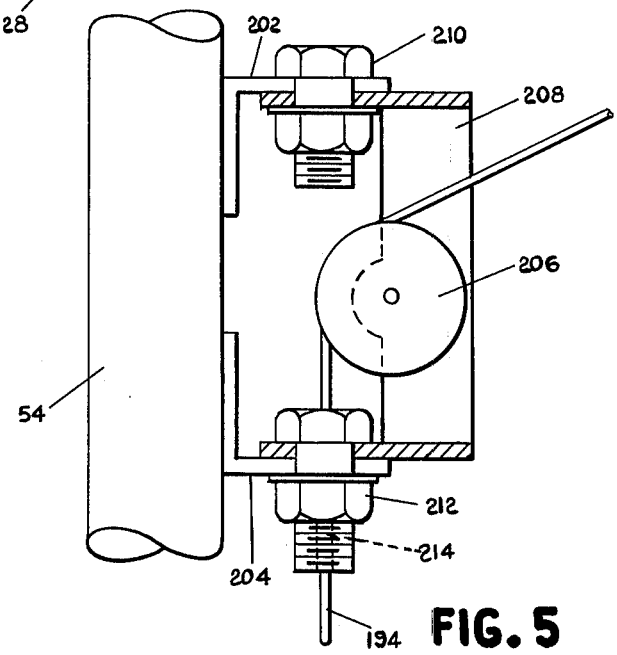
FIG. 5 is an enlarged, fragmentary detail view of the pivotally mounted pulley employed with the boom elevation system of the present invention.

As best seen in FIGS. 2, 5 and 9, the boom elevating mechanism includes a boom elevating winch 190 supported on a lower cross brace 192 of the A-frame 54. Cable 194 or other flexible connective member runs from winch 190 under a cable guide roller 196 and then upwardly to a pulley assembly 198 mounted on a cross brace 200. The cable then runs from pulley assembly 198 to an attachment point 202 at the lower end of counterbalance boom portion 106. The pulley assembly 198 includes a pair of angle brackets 202 and 204. The angle brackets support a pulley 206 rotatably supported in a housing 208. Housing 208 is secured for pivotal movement about the vertical or yaw axis of the boom by upper and lower bolt assemblies 210 and 212 respectively. The lower bolt assembly 212 includes a through passage 214. The cable 194 extends upwardly from the guide roller 196 which is also located in the vertical or yaw axis of the boom, through the bolt 112 and over the pulley 208. Therefore, as the boom swings, or yaws about its vertical axis, the pulley housing 208 also yaws on the same axis. Therefore, the length of cable 194 is unchanged by boom assembly yawing action. The amount of cable 194 reeled in or reeled out of the boom elevating winch 190 sets the elevational angle of the boom.

The counterbalance portion 106 of the boom is shorter in length than the hoisting section 104 of the boom assembly. This results in an overbalance in the unloaded, hoisting configuration, thereby maintaining tension on boom elevating cable 194 at all angles of elevation. Further, boom elevating cable 194 transfers the counterbalance forces acting on the boom assembly to a point near the center of the overall A-frame or derrick assembly at counterbalance pulley assembly 198. This feature eliminates the need for a massive boom counterbalance weight as is required on conventional derricks and cranes.

HOOK HOISTING MECHANISM

Figure 6:
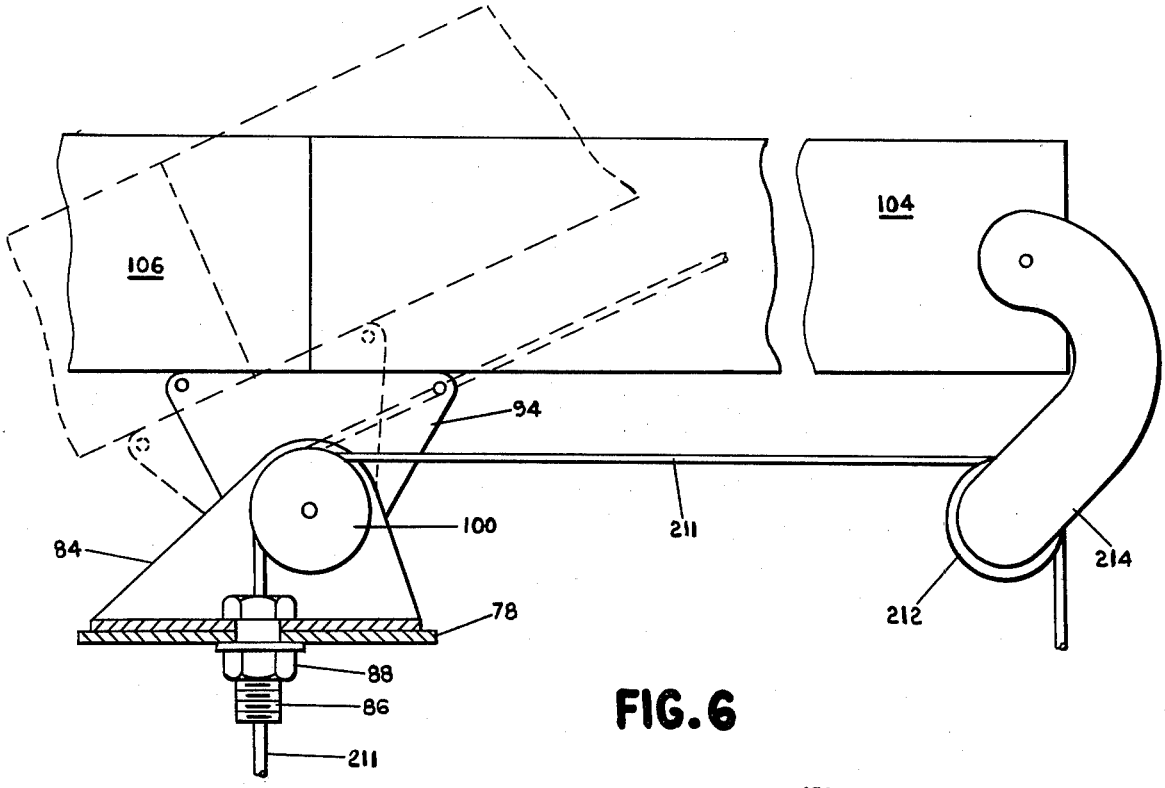
FIG. 6 is an enlarged detail view of a portion of the hoisting cable assembly.

As best seen in FIGS. 2, 3, 6, 8, 9 and 11, the hook hoisting mechanism includes a hoisting winch 210 fixedly secured to the rear of the cross brace 200. A hoisting cable 211 or other flexible load line is unreeled from winch 210 along the vertical axis or yawing axis of the boom upwardly through the pivot bolt 88 and over pulley 100 rotatably supported on pivot shaft 96 of the boom pivot assembly 80 (FIG. 11). As shown in FIG. 6, the cable then extends outwardly parallel to the boom hoisting section 104 and over a pulley 212 supported on a bracket 214 disposed on the end of the hoisting boom portion 104.

A hook 215 is attached to the end of the cable 211. As a result of this mounting arrangement, the hoisting cable length is unaffected by the yawing and/or pitching action of the boom. The boom elevation angle varies about the center of rotation of cable pulley 100 independently of the cable running. The cable runs off the pulley 100 along a tangent which coincides with the vertical yaw axis of the boom (FIG. 6). Therefore, the length of the cable depends only on the hoisting winch action in reeling out to lower hoisting hook 215 or reeling in to raise hoisting hook 215.

BOOM EXTENSION

As best seen in FIG. 3, the boom assembly 96 may include a boom extension or spar 220 secured at the end of the boom sector 104. The boom extension 220 is preferably mountable in two positions. The standard, normal position is the one shown in solid lines in FIG. 3 where the extension 220 is perpendicular to the hoisting portion 104. A plate 222 is mounted on the top portion of the boom 104 and includes a pin-receiving aperture. The plate 222 is positioned so that the extension 220 may be pivoted to an angle of 45° relative to the hoisting boom portion 104. A pin is inserted through the holes locking the extension in the alternative position. The boom extension assembly 220 located at the outer end of the hoisting boom segment 104 assists in balancing the boom when a load is not suspended on the hook. The boom extension 220 increases the reach of the boom and the height of hoisting hook travel.

From the above description, it is readily apparent that the preferred embodiment of the present invention illustrated in FIGS. 1–14 provides a collapsible boom and foldable derrick hoist arrangement which assumes a minimum space and a low profile for transportation. The assembly is readily mountable and demountable from the side rails of a conventional pickup truck. Due to the mounting arrangement, the bed of the pickup truck is free from obstruction, both during transit and during operation of the overall boom assembly. The boom elevation system, the boom yawing arrangement, and the hoisting system are wholly independent from each other in their operation. The main portions of the assembly may be fabricated from conventional steel plate and pipe with the boom readily fabricated from conventional steel I-beams. All of the winches employed in the various systems may be conventional electrically powered winches adapted to run off the electrical system of the pickup truck to which the assembly is mounted. This permits the crane to operate in varying field conditions and, therefore, to serve a wide variety of material lifting and moving needs.

ALTERNATIVE A-FRAME ERECTION SYSTEMS

Figure 15:
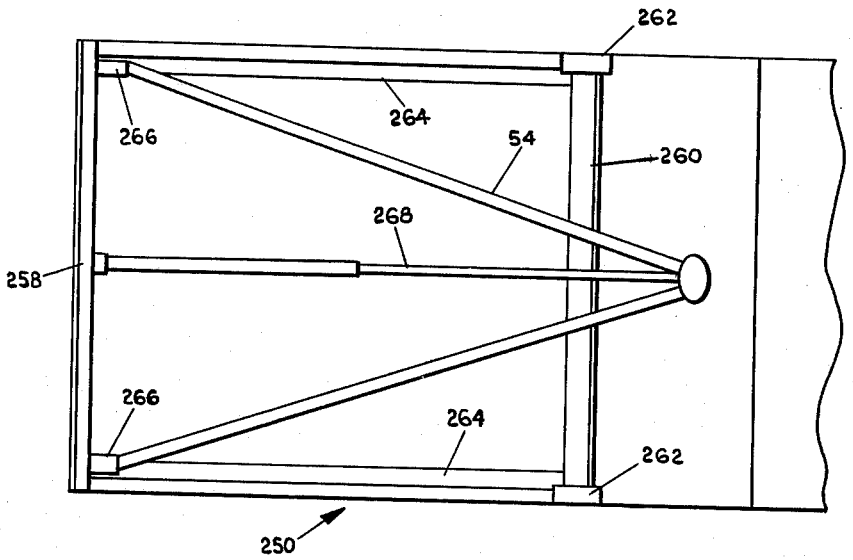
FIGS. 15 and 16 are plan and side elevational views of alternative boom erection structure in accordance with the present invention.
Figure 16:
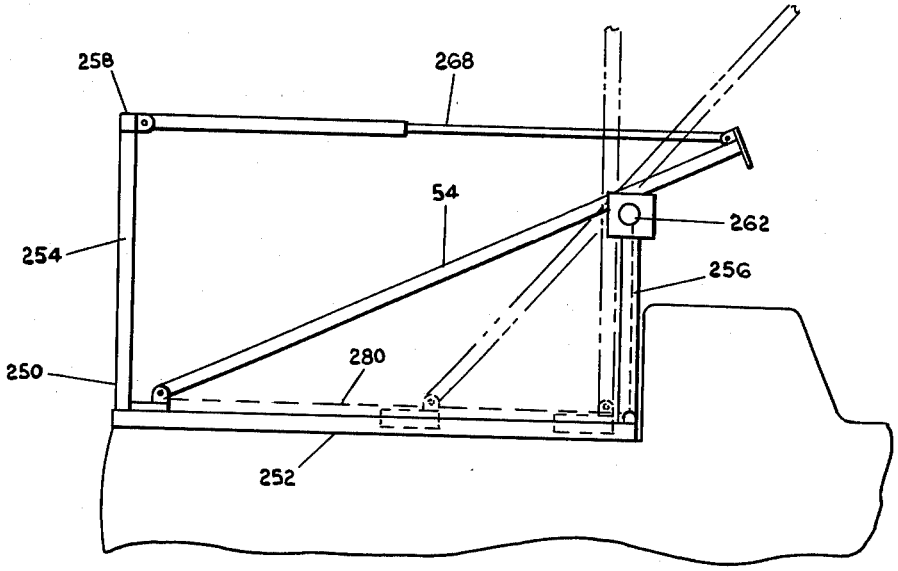
Figure 17:
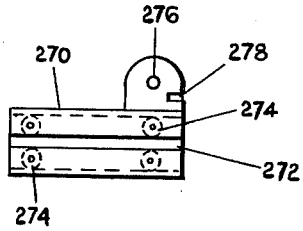
FIG. 17 is an enlarged detail of a portion of the structure of FIGS. 15 and 16.

FIGS. 15, 16 and 17 illustrate one alternative arrangement for erecting the A-frame 54. As shown, this arrangement includes a base frame 250 having a pair of generally U-shaped side rails 252 having upstanding legs 254 and 256. The legs 254 are interconnected by a rear cross member 258. The legs 256 are interconnected by a roller 260. The roller 260 is supported on its ends by a pair of bearing blocks 262. The side members 252 of the frame have secured thereto inwardly extending plates or tracks 264. The A-frame 54 is pivotally secured at the lower ends of its legs to slider assemblies 266. The slider assemblies 266 are adapted to ride on the tracks 264. A telescoping brace 268 is pivotally connected at one end to the truncated apex of the A-frame 54 and at the other end intermediate the ends of the cross member 258.

As best seen in FIG. 17, each slider assembly 266 includes a generally rectangular housing 270 having a longitudinally extending slit 272 formed in one side thereof for receiving the tracks 264. Mounted within the housing 270 above and below the slit 272 are rollers 274. A bracket 276 is integral with or weldably secured to the housing 270 and serves as a pivot attachment point for the legs of the A-frame 54. A tab 278 is also provided on the bracket 276. A cable 280 (FIG. 16) is secured at one end to the power driven roller 260 and at the other end to tab 278 on slider assembly 266. As is readily apparent from FIG. 16, rotation of the roller 260 pulls the slider assemblies and hence the legs of the A-frame 54 which rests on roller 260 toward the front of the truck thereby erecting or moving the A-frame 54 to a vertical position. A simple through pin may be employed to secure the telescoping portions of the brace leg 268 once the A-frame is erected.

Figure 18:
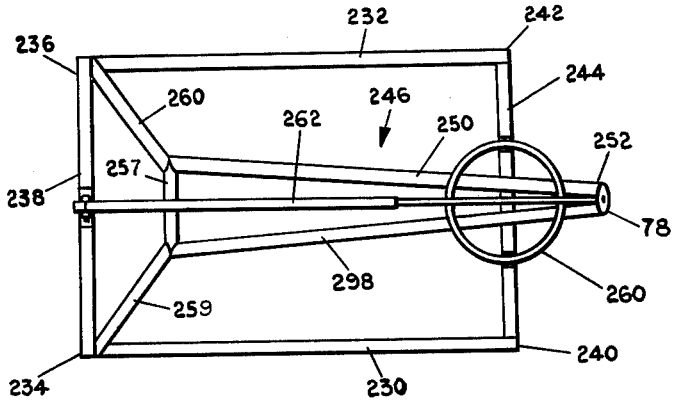
FIG. 18 is a plan view of another alternative frame erection structure.
Figure 19:
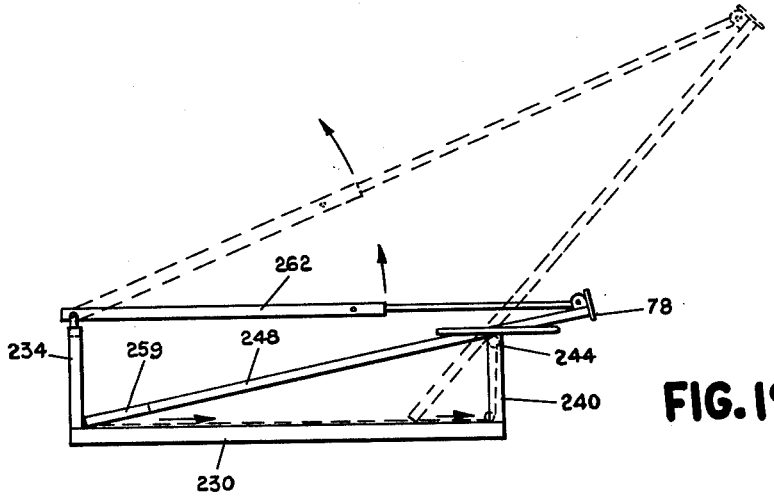
FIG. 19 is a side elevational view depicting the operation of the structure of FIG. 18.
Figure 20:
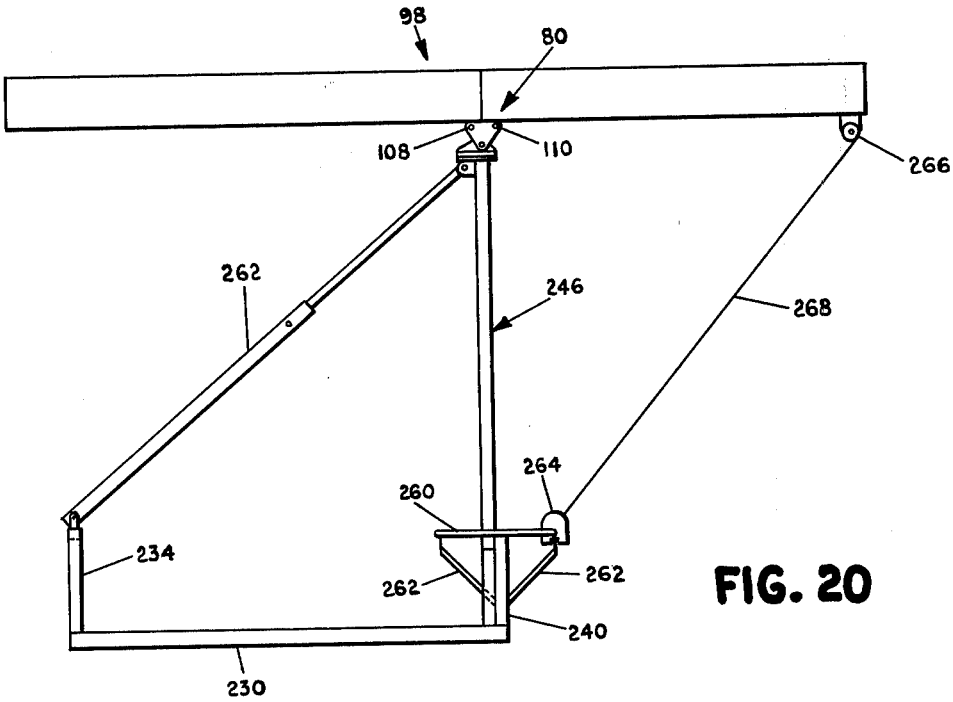
FIG. 20 is a side elevational view of the structure of FIG. 18 including an alternative boom elevation system.

FIGS. 18, 19 and 20 illustrate another alternative A-frame erection system and a boom elevation system. As shown, this alternative arrangement includes a base frame having side members 230 and 232. At the rear of the frame are a pair of upwardly extending struts or braces 234 and 236. Extending between the upper ends of the braces 234 and 236 is a rear cross member 238. At the forward end of the frame are a pair of upwardly extending forward struts 240 and 242. Rotatably positioned between the struts 240 and 242 at their upper ends is a roller 244. The roller 244 is operably connected to a motor (not shown). The A-frame structure in this alternative arrangement is generally designated 246 and includes legs 248 and 250 which meet at a truncated apex 252. At the apex is weldably secured bearing support plate 78. The legs 248 and 250 are interconnected at their lower ends by a cross brace member 257. A pair of legs 259 and 261 extend outwardly from the cross brace member 256 with their outer ends resting on the side members 230 and 232 of the base frame. A pair of cables are connected to the legs 259 and 261 at their outer ends and extend forwardly where they are secured to the roller 244. A telescoping brace 262 is pivotally secured at one end intermediate the ends of the rear cross member 238 and at the other end to the apex 252 of the A-frame 246.

As is apparent from FIG. 19, rotation of the roller 244 reels in the cables connected to the legs 258 and 260, pulling them in a forward direction, resulting in erection of the A-frame 246 to a vertical position (FIG. 20). A lock pin is inserted through apertures formed in telescoping brace 262 to fix the length and rigidly secure the A-frame in the erected position.

As best seen in FIG. 20, the boom assembly 98 is secured to the bearing plate 254 by pivot assembly 80. A boom elevation system including a ring track 260 is provided to permit 360° yawing movement. The ring track 260 is supported above the roller 244 intermediate the ends thereof by a pair of braces 262. A trolley 264 is adapted to ride on the ring 260. A boom elevation winch 266 is secured to the lower end of the counterbalance portion 106 of the beam assembly 96. A cable 268 is secured at its end to the trolley 264. Actuation of winch 266 changes the elevational angle of the boom assembly. As the boom is swung or moved about its yawing axis, trolley 264 moves around ring 260 thereby following the boom yawing movement through 360°. A-frame 246 is changed slightly in configuration from that employed in the previous embodiments so that the legs 248 and 250 may extend upwardly through the interior of the ring 260. This permits interference-free movement of the trolley 264 and the boom through 360°.

Thus, it will be appreciated that the present invention provides a collapsible boom and foldable derrick hoist assembly of relatively compact size which is readily mountable and demountable to the side rails of a pickup truck. The assembly of the present invention results in a material lifting apparatus having capabilities not found in previously available pickup mounted hoisting apparatus. As expressly intended, therefore, the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows:

1. A collapsible boom and derrick hoist assembly removably mountable on a vehicle, comprising:

a base frame adapted for mounting on a vehicle;

a derrick frame supported on said base frame for movement from a collapsed, transporting position to an erected operating position and including a leg pivotally connected to said base frame, said derrick frame having a boom mounting plate at one end thereof;

a foldable boom assembly having a hoisting section and a counterbalance section;

hoist means on said derrick frame and said boom for hoisting articles;

trunnion means rotatably secured to said boom mounting plate and operatively connected to said boom assembly for permitting yawing and pitching motion of said boom assembly, said hoisting section and said counterbalance section pivotally connected to said trunnion means and further including means for releasably securing each of said boom assembly sections together, whereby said boom assembly may be folded along the sides of said derrick frame for transporting; and derrick frame erection means on said base frame and operatively connected to said derrick frame for moving said frame from a collapsed transporting position to an erected hoisting position, said trunnion means comprising:

a lower yoke having a base and upstanding sides;

means rotatably securing said lower yoke to said boom mounting plate;

an upper yoke having depending sides; and a shaft hingedly connecting said upper and lower yokes through said upstanding and depending sides.

2. A collapsible boom and derrick hoist assembly as defined by claim 1 further including means for erecting said boom from a folded, transporting position to an erected, hoisting position.

3. A collapsible boom and derrick hoist assembly as defined by claim 2 wherein said boom erecting means comprises:

a boom erection strut pivotally connected at one end to said hoisting section adjacent the trunnion means for limited pivotal movement to an operating position in a vertical plane of said boom assembly;

means connected at one end to the top of said boom erection strut and at the other end to the free end of said boom hoisting section for pulling said boom hoisting section to a position where it can be secured to said counterbalance section by said securing means; and winch means mounted on the lower end of said counterbalance section and operatively connected to said boom erection strut for pivoting said boom erection strut to its operating position and then pivoting said hoisting section through said pulling means.

4. A collapsible boom and derrick hoist assembly removably mountable on a vehicle, comprising:

a base frame;

a derrick frame supported on said base frame for movement from a collapsed, transporting position to an erected operating position, said frame having a boom mounting plate at one end thereof;

a boom assembly having a hoisting section and a counterbalance section; and trunnion means rotatably secured to said boom mounting plate and operatively connected to said boom assembly for permitting yawing and pitching motion of said boom assembly, said boom assembly hoisting section being pivotally connected to said trunnion means and said counterbalance section being pivotally connected to said trunnion means and further including means for releasably securing each of said sections together, whereby said boom assembly may be folded along the sides of said derrick frame for transporting, said trunnion means comprising:

a lower yoke having a base and upstanding sides;

means rotatably securing said lower yoke to said boom mounting plate;

an upper yoke having depending sides; and a shaft hingedly connecting said upper and lower yokes through said upstanding and depending sides and said hoisting section being hingedly connected to one end of said upper yoke and said counterbalance section being hingedly connected to the other end of said upper yoke.

5. A collapsible boom and derrick hoist assembly as defined by claim 4 further including means operatively associated with said lower yoke for yawing said boom assembly.

6. A collapsible boom and derrick hoist assembly as defined by claim 5 wherein said yawing means comprises:

a driven gear secured to said lower yoke between said lower yoke and said boom mounting plate; and gear drive means for rotating said driven gear.

7. A collapsible boom and derrick hoist assembly as defined by claim 6 wherein said gear drive means includes:

a wheel rotatably mounted on said derrick frame;

a main drive shaft having bevel gears on opposite ends thereof, one of said bevel gears being rotated by said wheel, said main drive shaft rotatably supported on said derrick frame offset from and parallel to the vertical yaw axis of said trunnion means and said boom assembly;

a stub shaft rotatably supported on said derrick frame perpendicular to said main drive shaft and having another bevel gear secured thereon and a worm spaced from said another bevel gear, said other bevel gear on said main drive shaft meshing with said another bevel gear; and a final drive shaft rotatably supported on said derrick frame having a worm gear on one end meshing with said worm and a pinion gear on the other end meshing with said driven gear.

8. A collapsible boom and derrick hoist assembly as defined by claim 5 wherein said derrick frame includes:

an A-frame having a truncated apex;

at least one telescoping brace leg pivotally connected to said A-frame adjacent said apex; and said assembly further includes a socket mounted on said base frame for receiving the free end of said telescoping brace leg when said A-frame is erected to a vertical position.

9. A collapsible boom and derrick hoist assembly removably mountable on a vehicle, comprising:

a base frame adapted for mounting on a vehicle;

a derrick frame supported on said base frame for movement from a collapsed, transporting position to an erected operating position and including a leg pivotally connected to said base frame, said derrick frame having a boom mounting plate at one end thereof;

a foldable boom assembly having a hoisting section and a counterbalance section;

hoist means on said derrick frame and said boom for hoisting articles;

trunnion means rotatably secured to said boom mounting plate and operatively connected to said boom assembly for permitting yawing and pitching motion of said boom assembly, said hoisting section and said counterbalance section pivotally connected to said trunnion means and further including means for releasably securing each of said boom assembly sections together, whereby said boom assembly may be folded along the sides of said derrick frame for transporting; and derrick frame erection means on said base frame and operatively connected to said derrick frame for moving said frame from a collapsed transporting position to an erected hoisting position; and means connected to the lower end of said counterbalance section for pitching said boom assembly about the pitch axis of said trunnion assembly, said pitching means comprising:

a pitching pulley;

means for mounting said pitching pulley to said derrick frame, said mounting means being pivotal about the yaw axis of said boom assembly; and a winch including a cable running vertically along the boom yaw axis to said pitching pulley and then to the lower end of said counterbalance section.

10. A collapsible boom and derrick hoist assembly as defined by claim 4 further including means connected to the lower end of said counterbalance section for pitching said boom assembly about the pitch axis of said trunnion means.

11. A collapsible boom and derrick hoist assembly as defined by claim 10 wherein said pitching means comprises:

a pitching pulley;

means for mounting said pulley to said derrick frame, said mounting means being pivotal about the yaw axis of said boom assembly; and a winch including a cable running vertically along the boom yaw axis to said pitching pulley and then to the lower end of said counterbalance section.

12. A collapsible boom and derrick hoist assembly as defined by claim 11 further including derrick frame erecting means operatively associated with said derrick frame for moving said frame from a folded transporting position to an erected hoisting position.

13. A collapsible boom and derrick hoist assembly as defined by claim 12 wherein said base frame includes side members adapted to be removably secured to the side rails of a pickup and front and rear cross member and wherein said derrick frame erecting means comprises:

a support post secured to said rear cross member;

an auxiliary erecting strut pivotally connected to said support post;

means connected to said auxiliary erecting strut for moving said strut from a folded transporting position to an operating position;

a winch mounted on said forward cross member; and a flexible connective member extending from said winch to the derrick frame adjacent the boom mounting plate, said cable passing over the end of said auxiliary erecting strut when said frame is in the transporting position, whereby said strut increases the mechanical advantage of said winch when the derrick frame is being erected for use or folded for transportation.

14. A collapsible boom and derrick hoist assembly as defined by claim 13 wherein said means connected to said auxiliary strut includes:

a lever hingedly connected to said support post at a point below said auxiliary strut;

a connective member extending from the free end of said auxiliary strut to said lever;

a bracket on said support post below said lever, whereby downward movement of said lever raises said auxiliary strut; and means to secure said connective member to said bracket.

15. A collapsible boom and derrick hoist assembly as defined by claim 13 further including a plurality of stabilizer jack assemblies; means secured to said base frame and operatively connected to said stabilizer jack assemblies for allowing movement of said jack assemblies from a folded, transporting position to a vertical stabilizing and jacking position.

16. A collapsible boom and derrick hoist assembly as defined by claim 10 wherein said derrick frame includes;

an A-frame having a truncated apex;

at least one telescoping brace leg pivotally connected to said A-frame adjacent said apex; and said assembly further includes a socket mounted on said base frame for receiving the free end of said telescoping brace leg when said A-frame is erected to a vertical position.

17. A collapsible boom and derrick hoist assembly as defined by claim 10, further comprising a boom extension secured to the free end of said boom hoisting section, said boom extension being movable from a standard position perpendicular to said boom hoisting section to an alternative position at an angle of 45° relative to said boom hoisting section.

18. A collapsible boom and derrick hoist assembly removably mountable on a vehicle, comprising:

a base frame adapted for mounting on a vehicle;

a derrick frame supported on said base frame for movement from a collapsed, transporting position to an erected operating position and including a leg pivotally connected to said base frame, said derrick frame having a boom mounting plate at one end thereof;

a foldable boom assembly having a hoisting section and a counterbalance section;

hoist means on said derrick frame and said boom for hoisting articles;

trunnion means rotatably secured to said boom mounting plate and operatively connected to said boom assembly for permitting yawing and pitching motion of said boom assembly, said hoisting section and said counterbalance section pivotally connected to said trunnion means and further including means for releasably securing each of said boom assembly sections together, whereby said boom assembly may be folded along the sides of said derrick frame for transporting; and derrick frame erection means on said base frame and operatively connected to said derrick frame for moving said frame from a collapsed transporting position to an erected hoisting position; and said derrick frame erecting means operatively associated with said derrick frame for moving said frame from a folded transporting position to an erected hoisting position includes a winch mounted on the forward end of said base frame; a flexible connective member extending to said derrick frame adjacent said mounting plate; and means mounted at the rear of said base frame for movably mounting a strut between a non-operative position and an operative position, in said operative position the strut engages said flexible connective member when said derrick frame is in the transporting position for increasing the mechanical advantage of said winch when said derrick frame is being erected for use.

19. A collapsible boom and derrick hoist assembly as defined by claim 18 wherein said derrick frame includes;

an A-frame having a truncated apex;

at least one telescoping brace leg pivotally connected to said A-frame adjacent said apex; and said assembly further includes a socket mounted on said base frame for receiving the free end of said telescoping brace leg when said A-frame is erected to a vertical position.

20. A collapsible boom and derrick hoist assembly as defined by claim 1 wherein said hoisting means comprises:

a hoisting pulley mounted at the free end of said boom hoisting section;

an intermediate pulley mounted to said trunnion means so that said pulley has an axis of rotation coinciding with the pitch axis of said boom assembly;

a winch; and a hoist flexible connective member extending from said winch to said intermediate pulley along the yaw axis of said boom assembly and then to said hoisting pulley whereby hoisting action is independent of boom yawing and pitching motions.

21. A collapsible boom and derrick hoist assembly as defined by claim 20 wherein said means rotatably securing said lower yoke has a longitudinal passage therethrough and said hoist flexible connective member passes through said passage, and said intermediate pulley is rotatably supported on said shaft hingedly connecting said upper and lower yokes.

22. A collapsible boom and derrick hoist assembly removable mounted on a vehicle, comprising:

a base frame adapted for mounting on a vehicle;

a derrick frame supported on said base frame for movement from a collapsed, transporting position to an erected operating position and including a leg pivotally connected to said base frame, said derrick frame having a boom mounting plate at one end thereof;

a foldable boom assembly having a hoisting section and a counterbalance section;

hoist means on said derrick frame and said boom for hoisting articles;

trunnion means rotatably secured to said boom mounting plate and operatively connected to said boom assembly for permitting yawing and pitching motion of said boom assembly, said hoisting section and said counterbalance section pivotally connected to said trunnion means and further including means for releasably securing each of said boom assembly sections together, whereby said boom assembly may be folded along the sides of said derrick frame for transporting; and derrick frame erection means on said base frame and operatively connected to said derrick frame for moving said frame from a collapsed transporting position to an erected hoisting position, said base frame including:

an A-frame having a truncated apex;

at least one telescoping brace leg pivotally connected to said A-frame adjacent said apex; and said assembly further includes a socket mounted on said base frame for receiving the free end of said telescoping brace leg when said A-frame is erected to a vertical position and means extending between said base frame and said derrick frame for limiting forward pivotal movement of said derrick frame and for assisting in collapsing said derrick frame for transportation.

23. A collapsible boom and derrick hoist assembly removably mountable on a vehicle, comprising:

a base frame adapted for mounting on a vehicle;

a derrick frame supported on said base frame for movement from a collapsed, transporting position to an erected operating position and including a leg pivotally connected to said base frame, said derrick frame having a boom mounting plate at one end thereof;

a foldable boom assembly having a hoisting section and a counterbalance section;

hoist means on said derrick frame and said boom for hoisting articles;

trunnion means rotatably secured to said boom mounting plate and operatively connected to said boom assembly for permitting yawing and pitching motion of said boom assembly, said hoisting section and said counterbalance section pivotally connected to said trunnion means and further including means for releasably securing each of said boom assembly sections together, whereby said boom assembly may be folded along the sides of said derrick frame for transporting; and derrick frame erection means on said base frame and operatively connected to said derrick frame for moving said frame from a collapsed transporting position to an erected hoisting position, said base frame including generally U-shaped side members adapted to be removably mounted to the side rails of a pickup truck withh the base of each of said side members on one of said rails and a rear cross member extending between the rear legs of said side members, said derrick including an A-frame having a truncated apex and at least one telescoping brace leg pivotally connected at one end to said A-frame adjacent said apex and wherein said derrick frame erecting means comprises:

a power driven roller extending between the front legs of said side members, said A-frame resting on said roller and the ends of the legs of said A-frame sliding on the base portions of said side members; and flexible connective members secured at one end to the end of the legs of said A-frame and at the other end to said roller.

24. A collapsible boom and derrick hoist assembly as defined by claim 23 further including:

roller slides pivotally connected to the leg ends of said A-frame; and track means secured to said base portions of said side members, said roller slides riding on said track means.

25. A collapsible boom and derrick hoist assembly as defined by claim 23 further including a boom pitching means comprising:

a circular track mounted to said base frame between the side members and below said roller;

a trolley adapted to ride on said circular track;

a winch mounted to the lower, rear end of said boom counterbalance section; and a flexible connective member secured between said trolley and said winch.

* * * * *

UNITED STATES PATENT AND TRADEMARK OFFICE

CERTIFICATE OF CORRECTION

PATENT NO. : 4,068,762

DATED : January 17, 1978

INVENTOR(S) : Dwight Clinton Kennard, Jr. et al

It is certified that error appears in the above-identified patent and that said Letters Patent are hereby corrected as shown below:

Cover sheet, item 76, should read:

--Inventors: Dwight Clinton Kennard, Jr.; James Clinton Kennard, both of 3830 Incochee Trail, Traverse City, Michigan 49684.--

Column 4, line 62:

"Both members" should be --Boom members--.

Column 16, line 1:

"withh" should be --with--.

Column 16, line 2:

"one of said rails" should be --one of said side rails--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*